US009557709B1

(12) United States Patent
Momomura et al.

(10) Patent No.: US 9,557,709 B1
(45) Date of Patent: Jan. 31, 2017

(54) BLOWER DUCT, BLOWER DEVICE, AND IMAGE FORMING APPARATUS

(71) Applicant: FUJI XEROX CO., LTD., Tokyo (JP)

(72) Inventors: Yasunori Momomura, Kanagawa (JP); Yuki Nagamori, Kanagawa (JP); Yu Tsuda, Kanagawa (JP); Yasunori Unagida, Kangawa (JP); Mihoko Tanaka, Kanagawa (JP); Masafumi Kudo, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/048,437

(22) Filed: Feb. 19, 2016

(30) Foreign Application Priority Data

Sep. 25, 2015 (JP) ..... 2015-188435

(51) Int. Cl.
*G03G 21/20* (2006.01)
*G03G 15/02* (2006.01)

(52) U.S. Cl.
CPC ..... *G03G 21/206* (2013.01); *G03G 15/0291* (2013.01)

(58) Field of Classification Search
CPC ... G03G 21/20; G03G 21/206; G03G 15/0291
See application file for complete search history.

(56) References Cited

U.S. PATENT DOCUMENTS 8,759,766 B2 6/2014 Momomura et al.
8,855,519 B2 * 10/2014 Katahira ..... G03G 21/206 399/92
9,098,008 B2 8/2015 Inami et al.
9,158,275 B2 * 10/2015 Inami ..... G03G 15/0291

FOREIGN PATENT DOCUMENTS

JP 2013-088731 A 5/2013
JP 2013-125175 A 6/2013

* cited by examiner

*Primary Examiner* — Hoang Ngo
(74) *Attorney, Agent, or Firm* — Oliff PLC

(57) ABSTRACT

A blower duct includes a path section including an entrance path section having an inlet through which air is taken in, a first bent path section, and a second bent path section having an outlet facing a longitudinal-direction portion; a first flow control member that makes a portion of the path of the first bent path section narrower than other portion of the path and causes an elongated gap extending in the longitudinal direction to pass the air; and a second flow control member constituted of an air permeable member having air permeable sections at the outlet. One of the paths located downstream of the first flow control member in an air flowing direction is partially provided with an inclined inner wall surface that is inclined from above to extend toward an upper portion of a downstream opening end of the narrowed path in the first flow control member.

6 Claims, 16 Drawing Sheets

BLOWER DUCT, BLOWER DEVICE, AND IMAGE FORMING APPARATUS

CROSS-REFERENCE TO RELATED APPLICATIONS

This application is based on and claims priority under 35 USC 119 from Japanese Patent Application No. 2015-188435 filed Sep. 25, 2015.

BACKGROUND

Technical Field

The present invention relates to blower ducts, blower devices, and image forming apparatuses.

SUMMARY

According to an aspect of the invention, there is provided a blower duct including a path section, a first flow control member, and a second flow control member. The path section includes an entrance path section having a path whose one end is provided with an inlet through which air is taken in, a first bent path section having a path that bends in a horizontal direction from an intermediate point of the entrance path section, and a second bent path section having a path that bends downward from a terminal end of the first bent path section and that is provided with an outlet at a downwardly-bent terminal end. The outlet has an opening shape extending so as to face a longitudinal-direction portion that is long in one direction of a target structure to which the air taken in through the inlet is blown. The first flow control member makes a portion of the path of the first bent path section narrower than other portion of the path and causes an elongated gap extending in the longitudinal direction to pass the air. The second flow control member is constituted of an air permeable member having multiple air permeable sections provided at the outlet. Of the paths of the path section, a path located downstream of the first flow control member in an air flowing direction is partially provided with an inclined inner wall surface that is inclined from above so as to extend toward an upper portion of a downstream opening end, in the air flowing direction, of the narrowed path in the first flow control member.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described below with reference to the appended drawings.

First Exemplary Embodiment

Figure 1:
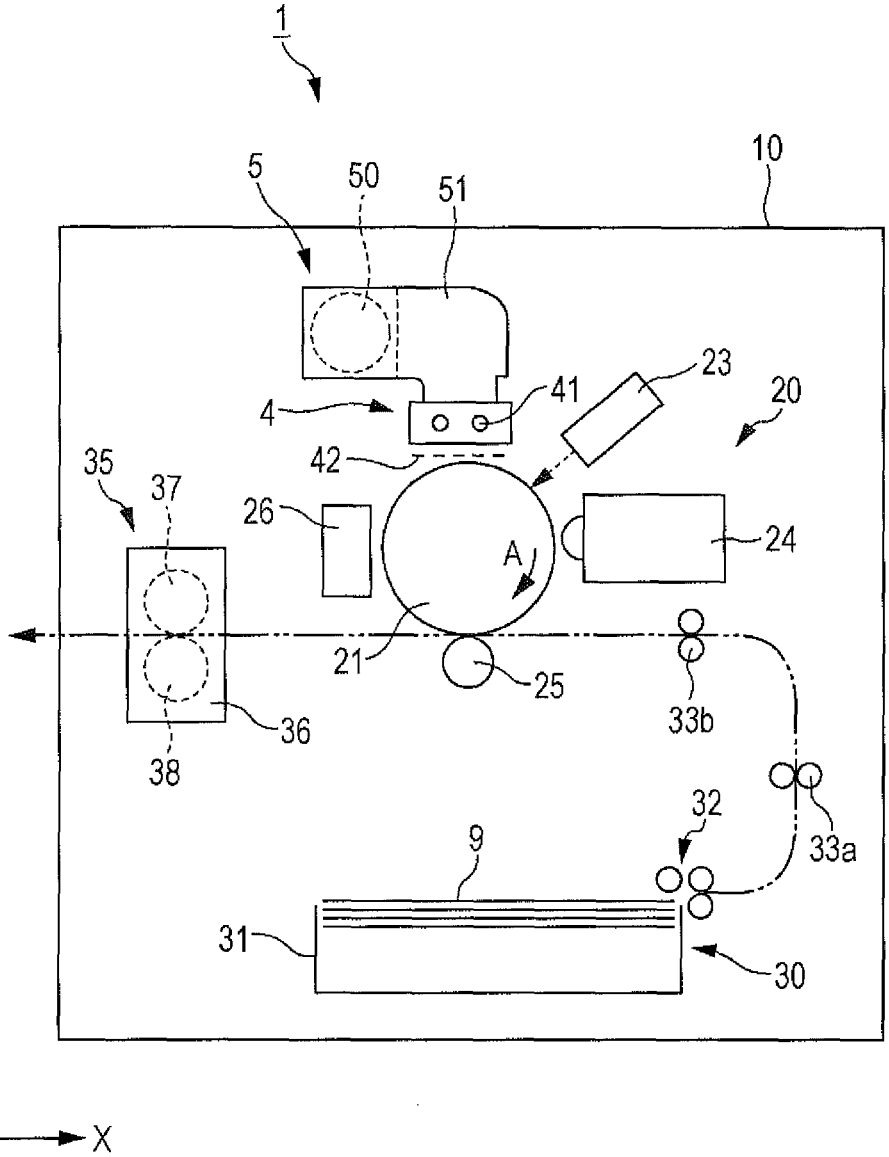
FIG. 1 schematically illustrates an image forming apparatus equipped with a blower device according to a first exemplary embodiment.
Figure 2:
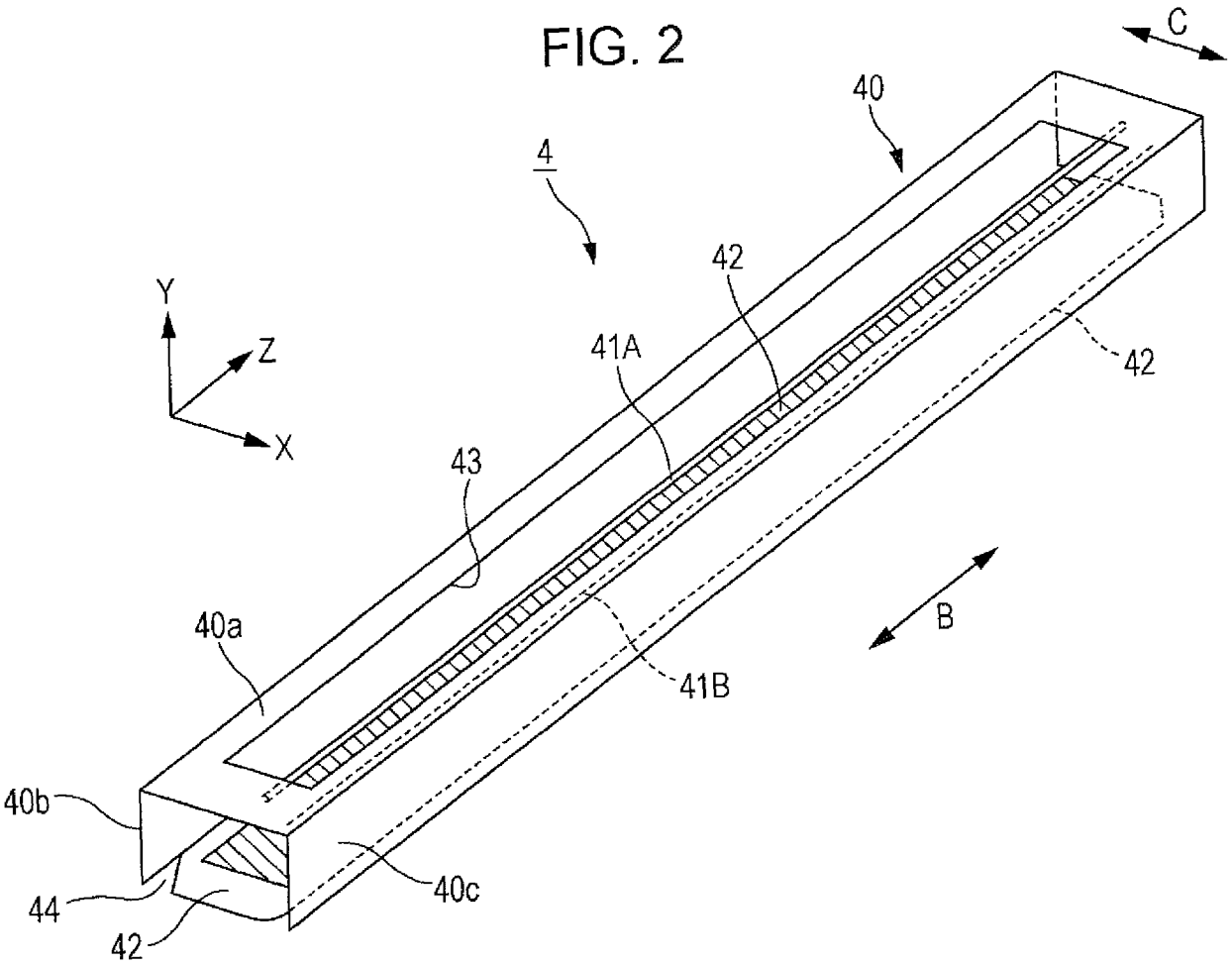
FIG. 2 is a perspective view schematically illustrating a charging device equipped in the image forming apparatus in FIG. 1.
Figure 3:
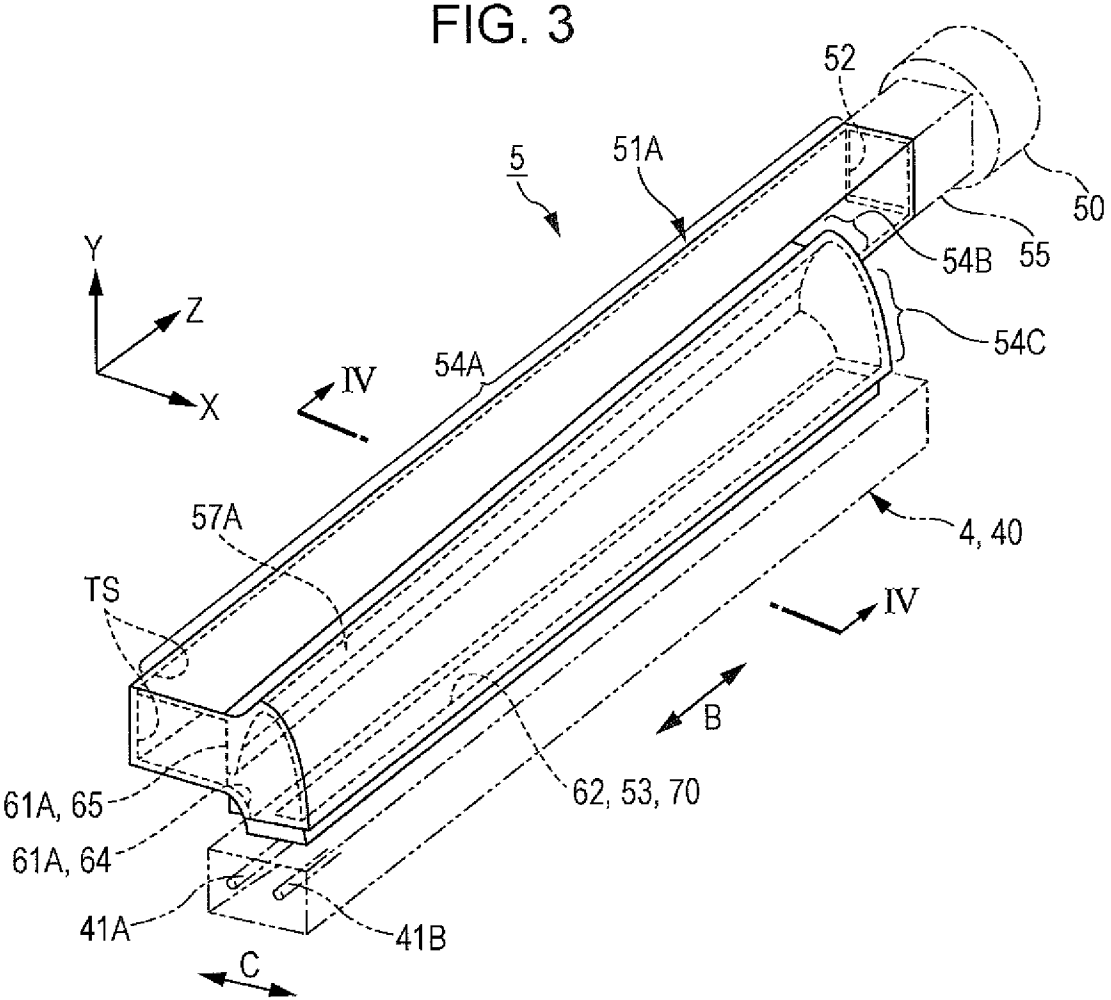
FIG. 3 is a perspective view schematically illustrating the blower device applied to the charging device in FIG. 2.
Figure 4:
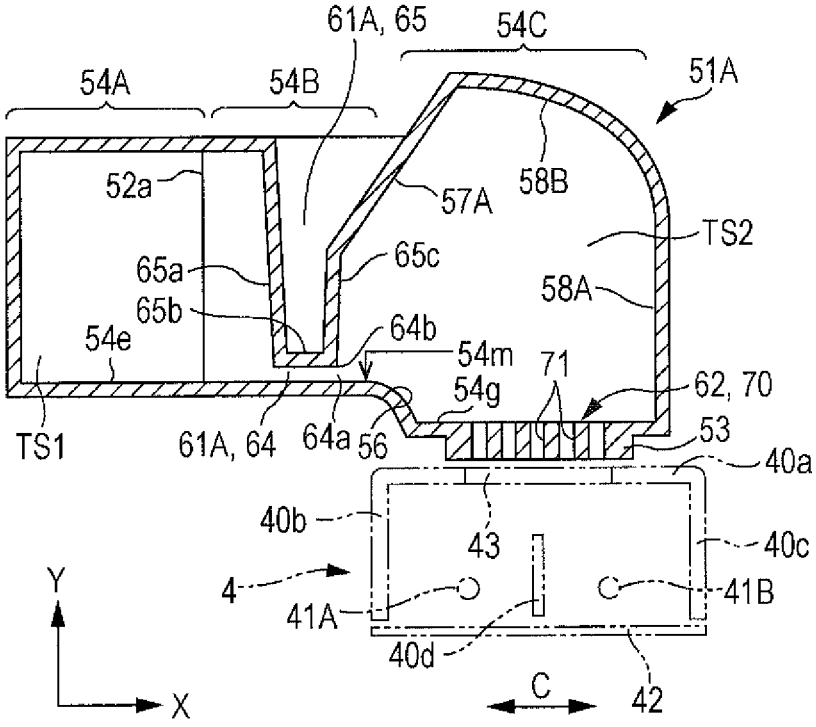
FIG. 4 is a cross-sectional view of the blower device (blower duct) in FIG. 3, taken along line IV-IV.

FIGS. 1 to 4 illustrate a blower duct, a blower device equipped with the blower duct, and an image forming apparatus according to a first exemplary embodiment. Specifically, FIG. 1 schematically illustrates the image forming apparatus, FIG. 2 illustrates a charging device as an example of a target structure to which air is blown by the blower duct or the blower device, FIG. 3 schematically illustrates the blower duct or the blower device, and FIG. 4 is a cross-sectional view of, for example, the blower duct.

Configuration of Image Forming Apparatus

As shown in FIG. 1, an image forming apparatus 1 has a housing 10 constituted of, for example, a support frame or an outer cover. For example, an image forming unit 20, which forms a toner image formed of a toner as a developer and transfers the toner image onto recording paper 9 as an example of a recording medium; a paper feeding device 30, which accommodates and transports the recording paper 9 to be fed to the image forming unit 20; and a fixing device 35, which fixes the toner image formed by the image forming unit 20 onto the recording paper 9, are disposed inside the housing 10.

For example, the image forming unit 20 is of a known electrophotographic type. The image forming unit 20 according to the first exemplary embodiment includes a photoconductor drum 21 that is rotationally driven in a direction indicated by an arrow A; a charging device 4 that electrostatically charges, to a predetermined potential, a peripheral surface serving as an image formation region of the photoconductor drum 21; an exposure device 23 that radiates light (indicated by a dotted line with an arrow) based on image information (signal) input from the outside onto the electrostatically-charged peripheral surface of the photoconductor drum 21 so as to form an electrostatic latent image thereon; a developing device 24 that develops the electrostatic latent image into a toner image by using the toner; a transfer device 25 that transfers the toner image from the photoconductor drum 21 to the recording paper 9; and a cleaning device 26 that cleans the peripheral surface of the photoconductor drum 21 after the transfer process by removing waste, such as residual toner, therefrom.

A corona discharger is used as the charging device 4. As shown in, for example, FIG. 2, the charging device 4 constituted of the corona discharger is a so-called scorotron-type corona discharger.

Specifically, the charging device 4 includes a shield case 40 as an example of an enclosure member, two end supporters (not shown), two corona discharge wires 41A and 41B, and a porous grid electrode (electric-field adjustment plate) 42. The shield case 40 has a rectangular top plate 40*a* and side plates 40*b* and 40*c* hanging downward from the long edges, which extend in a longitudinal direction B, of the top plate 40*a*. The two end supporters are respectively attached to the opposite ends (i.e., short edges) of the shield case 40 in the longitudinal direction B. The two corona discharge wires 41A and 41B are disposed within a long internal space formed between the two end supporters and extending in the longitudinal direction. B of the shield case 40. The two corona discharge wires 41A and 41B are attached in a manner such that they extend substantially parallel to each other. The grid electrode 42 is attached to a discharge lower opening 44 of the shield case 40 so as to substantially cover the lower opening 44 and to be located between the corona discharge wires 41A and 41B and the peripheral surface of the photoconductor drum 21. Reference character 40*d* in, for example, FIG. 4 denotes a partition plate that partitions, in the longitudinal direction B of the shield case 40, the space in which the two corona discharge wires 41A and 41B are disposed. The lower opening 44 has a rectangular opening shape.

In the charging device 4, the two corona discharge wires 41A and 41B are disposed so as to face the peripheral surface of the photoconductor drum 21 with a predetermined distance (e.g., a discharge gap) therebetween and also to face the image formation region of the photoconductor drum 21 along a rotation shaft thereof. Furthermore, in the charging device 4, when an image forming operation is to be performed, charge voltage is supplied from a power source (not shown) between each of the corona discharge wires 41A and 41B and the photoconductor drum 21.

Moreover, as the charging device 4 is used, the corona discharge wires 41A and 41B and the grid electrode 42 may become contaminated due to paper particles from the recording paper 9, discharge products produced from corona discharge, and substances (waste), such as external additives in the toner. This may result in charge defects, such as uneven charge, due to insufficient or nonuniform corona discharge. Thus, for the prevention or reduction of the adhesion of waste onto the corona discharge wires 41A and 41B and the grid electrode 42, a blower device 5 for blowing air toward the corona discharge wires 41A and 41B and the grid electrode 42 is provided for the charging device 4. The top plate 40*a* of the shield case 40 of the charging device 4 has an opening 43 for taking in the air blown from the blower device 5. The opening 43 has a rectangular opening shape. A detailed description of the blower device 5 will be provided later.

The paper feeding device 30 includes a paper accommodation body 31 that accommodates a stack of multiple sheets of recording paper 9 of, for example, a predetermined size and type to be used for image formation, and a delivering device 32 that delivers the sheets of recording paper 9 accommodated in the paper accommodation body 31 one-by-one toward a transport path. When it is time to feed the recording paper 9, the sheets of recording paper 9 are delivered one-by-one. In accordance with the intended use, multiple paper accommodation bodies 31 are provided. A two-dot chain line with an arrow in FIG. 1 denotes a transport path along which the recording paper 9 is transported and moved inside the housing 10. The transport path for the recording paper 9 is constituted of, for example, multiple pairs of paper transport rollers 33*a* and 33*b* and a transport guide member (not shown).

The fixing device 35 includes a heating rotation body 37 and a pressing rotation body 38 inside a housing 36 having an entrance port and an exit port through which the recording paper 9 passes. The heating rotation body 37 is of, for example, a roller type or a belt type whose surface temperature is heated and maintained at a predetermined temperature by a heater. The pressing rotation body 38 is of, for example, a roller type or a belt type that is rotationally driven by coming into contact with the heating rotation body 37, with a predetermined pressure, substantially along a shaft thereof. In the fixing device 35, a contact section formed as a result of the heating rotation body 37 and the pressing rotation body 38 coming into contact with each other serves as a fixing processor where a predetermined fixing process (heating and pressing) is performed. The fixing process is performed by causing the recording paper 9 that has undergone a toner-image transport process to enter and pass through the contact section.

An image forming operation is performed by the image forming apparatus 1 in the following manner. A basic image forming operation performed when forming an image onto one face of the recording paper 9 will be described here as a representative example.

In the image forming apparatus 1, for example, when a controller (not shown) receives an image-forming-operation start command, the peripheral surface of the photoconductor drum 21 that starts to rotate in the image forming unit 20 is electrostatically charged to a predetermined polarity and potential by the charging device 4. In the charging device 4, charge voltage is applied to each of the two corona discharge wires 41A and 41B so that corona discharge is generated in a state where an electric field is generated between each corona discharge wire 41A, 41B and the peripheral surface of the photoconductor drum 21, whereby the peripheral surface of the photoconductor drum 21 is electrostatically charged to a predetermined potential. In this case, the charge potential of the photoconductor drum 21 is adjusted by the grid electrode 42.

Subsequently, the exposure device 23 radiates light based on image information onto the electrostatically-charged peripheral surface of the photoconductor drum 21 so as to form an electrostatic latent image having a predetermined potential. Then, as the electrostatic latent image formed on the photoconductor drum 21 passes through the developing device 24, the electrostatic latent image is developed into a visible toner image by using a toner electrostatically charged to a predetermined polarity and supplied from a developing roller.

Subsequently, when the toner image formed on the photoconductor drum 21 is transported to a transfer position facing the transfer device 25 due to the rotation of the photoconductor drum 21, a transfer function of the transfer device 25 causes the toner image to be transferred onto the recording paper 9, which is fed from the paper feeding device 30 via the transport path in accordance with this timing. After this transfer process, the peripheral surface of the photoconductor drum 21 is cleaned by the cleaning device 26.

Then, the recording paper 9 having the toner image transferred thereon at the image forming unit 20 is separated from the photoconductor drum 21 and is subsequently transported to the fixing device 35. As the recording paper 9 passes through the contact section between the heating rotation body 37 and the pressing rotation body 38 of the fixing device 35, the recording paper 9 is pressed and heated so that the toner image fuses and becomes fixed onto the recording paper 9. Upon completion of this fixing process, the recording paper 9 is output from the fixing device 35 and is transported and accommodated into an output-paper accommodation section (not shown) provided, for example, outside the housing 10.

Accordingly, a monochromatic image formed of one color of toner is formed on one face of a single sheet of recording paper 9, and the basic image forming operation ends. If there is a command for forming images onto multiple sheets of recording paper 9, the above-described series of operation is similarly repeated for the number of sheets.

Configuration of Blower Device

Next, the blower device 5 will be described.

As shown in, for example, FIGS. 1 and 3, the blower device 5 includes a blower 50 having a rotating fan that blows air and a blower duct 51A that takes in the air blown from the blower 50 and guides and ejects the air to the charging device 4 as an example of a target structure to which the air is blown.

For example, a radial-flow blower fan is used as the blower 50. The blower 50 is driven and controlled so as to blow a predetermined amount of air.

As shown in, for example, FIGS. 3 to 7, the blower duct 51A has an inlet 52, an outlet 53, a path section (body section) 54, and a first controller 61A and a second controller 62. The air blown from the blower 50 is taken in through the inlet 52. The outlet 53 is disposed facing a longitudinal-direction-B portion (i.e., the opening 43 in the top plate 40*a* of the shield case 40) that is long in one direction of the long charging device 4 to which the air taken in through the inlet 52 is blown. The outlet 53 causes the air to flow and exit in a direction orthogonal to the longitudinal direction B. In the path section 54, a path TS that connects the inlet 52 and the outlet 53 for allowing the air to flow therethrough is bent twice at intermediate points of the path section 54. The first controller 61A and the second controller 62 serve as two flow control members that control the flow of air and that are provided at different locations in the direction in which the air flows through the path TS of the path section 54.

The inlet 52 of the blower duct 51A has a rectangular opening shape in its entirety, which is slightly longer in the vertical direction. A connection duct 55 for connecting the inlet 52 and the blower 50 so as to deliver the air produced by the blower 50 to the inlet 52 is attached to the inlet 52 of the blower duct 51A (FIG. 3).

The outlet 53 of the blower duct 51A has, for example, a narrow rectangular opening shape in its entirety and extends in a state where the outlet 53 faces the longitudinal-direction-B portion (i.e., the opening 43 in the shield case 40 in actuality) of the charging device 4. As shown in, for example, FIGS. 4 and 6, in actuality, the outlet 53 is formed so as to have a slightly narrower opening area than the entire bottom surface (terminal end) of a section located at the outlet 53 side of the path section 54 (i.e., a second bent path section 54C).

Figure 5:
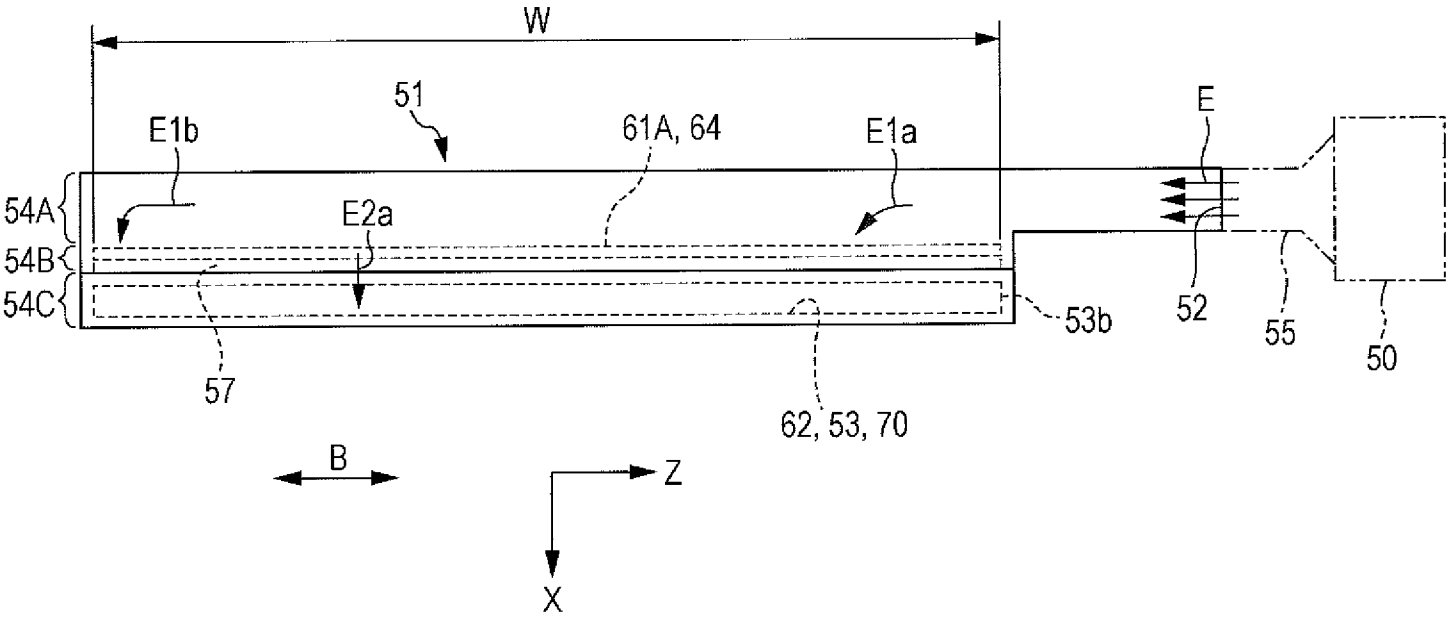
FIG. 5 schematically illustrates the blower device in FIG. 3, as viewed from above.

As shown in, for example, FIGS. 3 to 5, the path section 54 of the blower duct 51A is constituted of an entrance path section 54A, a first bent path section 54B, and a second bent path section 54C.

With regard to the entrance path section 54A, a first open end thereof is provided with the inlet 52, and a second end thereof is closed. The entire entrance path section 54A is a path section with an angular tubular shape having a path TS extending linearly and substantially parallel to the longitudinal direction B of the outlet 53 (i.e., the same as the longitudinal direction B of the charging device 4).

The first bent path section 54B has an angular tubular shape having a path TS that extends so as to be bent at a substantially right angle in the substantially horizontal direction (i.e., a direction substantially parallel to a direction indicated by a coordinate axis X), which is a lateral direction, from an area (intermediate area) located toward the second end of the entrance path section 54A. Moreover, as compared with the entrance path section 54A, the first bent path section 54B is wider in the lateral direction and is increased in overall cross-sectional area by widening only the width (i.e., the dimension in the longitudinal direction B) while maintaining the same height of the path TS. A bottom surface 54*e* constituting the path TS of the first bent path section 54B is a flat surface.

The second bent path section 54C has a path TS that is bent downward (in a direction substantially parallel to a direction indicated by a coordinate axis Y) from a downstream end (terminal end), in the direction in which the air flows through the first bent path section 54B, so as to extend toward the charging device 4. Moreover, as compared with the first bent path section 54B, the second bent path section 54C is wider in the lateral direction and is bent downward while the same width of the path TS (i.e., the dimension in the longitudinal direction B) is maintained. Furthermore, as shown in, for example, FIGS. 4 and 7, in the second bent path section 54C, an inner wall surface section 56 between a terminal end 54*m* of the flat portion of the bottom surface 54*e* in the path TS of the first bent path section 54B and a terminal end surface 54*g* in the path TS of the second bent path section 54C is formed as a curved surface (i.e., a curved inner wall surface section) that protrudes into the path TS. The terminal end surface 54*g* in the path TS of the second bent path section 54C is formed to provide a height difference h1 (FIG. 7) relative to the flat portion of the bottom surface 54*e* in the path TS of the first bent path section 54B. The terminal end of the second bent path section 54C is provided with the outlet 53 having the above-described configuration.

Figure 7:
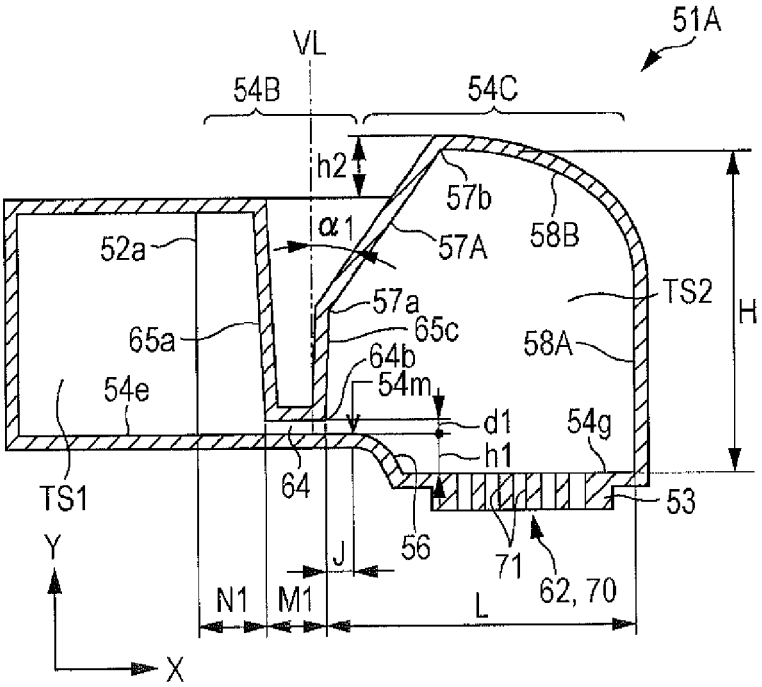
FIG. 7 illustrates the configuration of the blower device in FIG. 3 in detail.

As shown in, for example, FIGS. 4 and 7, the first flow control member 61A in the blower duct 51A partially traverses and blocks the path TS in the first bent path section 54B, and has a gap 64 extending linearly in the traversing direction.

Specifically, the first flow control member 61A forms a state where it causes a portion that forms the external shape of the first bent path section 54B to be depressed into the path TS thereof so as to partially traverse and block the path TS. Moreover, the first flow control member 61A provides the gap 64 having a predetermined spacing distance d1 between the bottom surface 54*e* of the path TS and the first flow control member 61A. A portion 65 that partially traverses and blocks the path TS serves a blocking portion that constitutes the first flow control member 61A.

In the first exemplary embodiment, the blocking portion 65 in the first flow control member 61A is disposed such that the traversing direction thereof within the path TS is parallel to the longitudinal direction B of the outlet 53. Furthermore, the blocking portion 65 is disposed such that a lower end of an inner wall surface section 65*a*, which is at the upstream side in the air flowing direction, is displaced by a predetermined distance N1 from an end 52*a*, which is located closer toward the outlet 53, of the inlet 52 toward the downstream side in the air flowing direction in the first bent path section 54B (FIG. 7). The upstream inner wall surface section 65*a* of the blocking portion 65 is a flat surface. Moreover, the blocking portion 65 is disposed such that a lower end of an inner wall surface section 65*c* (corresponding to an upper portion of a downstream opening, to be described later, of the gap 64), which is at the downstream side in the air flowing direction, is displaced by a predetermined distance J toward the upstream side in the air flowing direction relative to the terminal end 54*m* of the flat portion of the bottom surface constituting the path TS of the first bent path section 54B (FIG. 7).

The gap 64 in the first flow control member 61A is located between a lower-end inner wall surface section 65*b* of the blocking portion 65 and the bottom surface 54*e* in the path TS of the first bent path section 54B. Similar to the blocking portion 65, the gap 64 extends in the direction in which the blocking portion 65 partially traverses the path TS. Moreover, similar to the blocking portion 65, the gap 64 according to the first exemplary embodiment is disposed parallel to the longitudinal direction B of the outlet 53. Furthermore, the width (i.e., the length thereof in the longitudinal direction B) of the gap 64 is set to be equal to a width W (FIG. 5) of the path TS of the first bent path section 54B. Moreover, a path length M1 of the gap 64 is set to a predetermined dimension by the lower-end inner wall surface section 65*b* of the blocking portion 65.

Although the blocking portion 65 that forms the gap 64 in the first flow control member 61A may be obtained by being integrally molded using the same material as the blower duct 51A, the blocking portion 65 may alternatively be obtained by being formed using a material different from the blower duct 51A. With regard to the blocking portion 65, the position thereof (i.e., the aforementioned distance N1) and the spacing distance d1, the path length M1, and the width W of the gap 64 are selected and set in view of making the flow speed of air flowing in from the entrance path section 54A to the first bent path section 54B uniform as much as possible. These values are also set in view of, for example, the dimensions (i.e., the capacity) of the blower duct 51A as well as the flow rate (amount) per unit time of air to be blown to the blower duct 51A or the charging device 4.

Furthermore, as shown in, for example, FIGS. 4 and 7, the second flow control member 62 in the blower duct 51A is provided as a flow control member that blocks the outlet 53 by using an air permeable member 70 having multiple air permeable sections 71.

Figure 6:
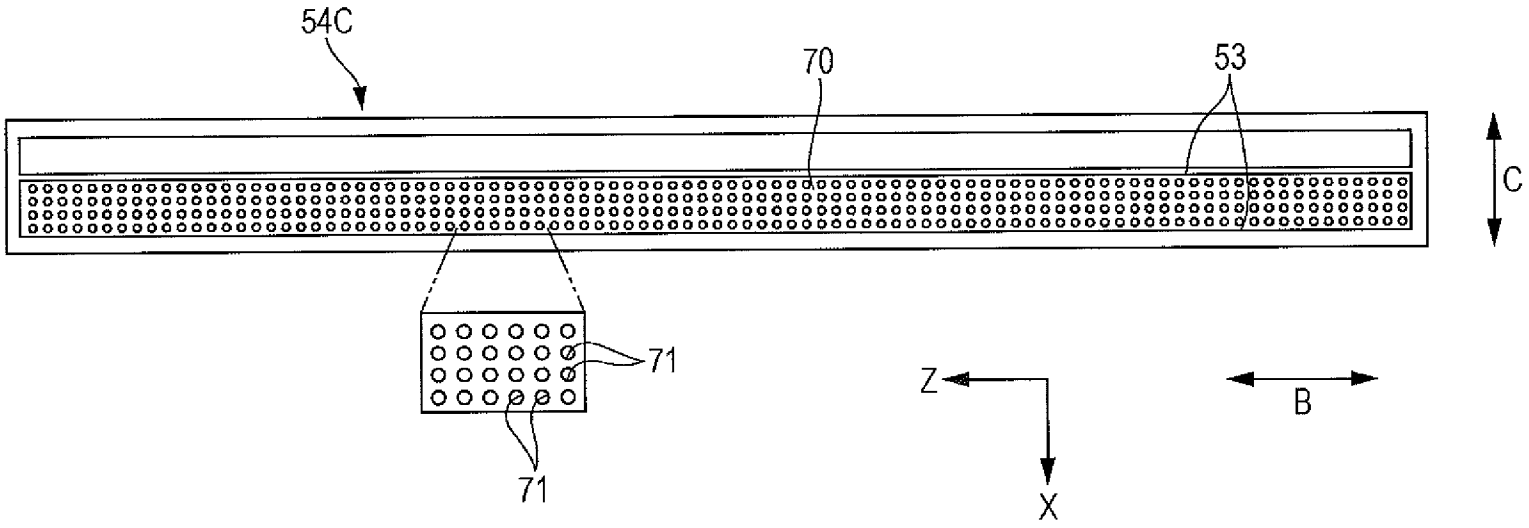
FIG. 6 schematically illustrates the blower device in FIG. 3, as viewed from below (i.e., from an outlet)

As shown in, for example, FIGS. 4 and 6, the multiple air permeable sections 71 are linearly-extending through-holes each having a substantially circular opening shape. For example, the multiple air permeable sections 71 are arranged at regular pitch in the longitudinal direction B of the opening shape of the outlet 53 and are also arranged at pitch equal to the regular pitch in a lateral direction C orthogonal to the longitudinal direction B so as to form multiple rows (e.g., five rows). Thus, the multiple air permeable sections (holes) 71 are substantially uniformly arranged in the path TS at the terminal end of the second bent path section 54C or in the entire region of the outlet 53. Therefore, the air permeable member 70 according to the first exemplary embodiment is a porous plate having the multiple air permeable sections (holes) 71 arranged in a plate-shaped member.

The air permeable member 70 may be obtained by being integrally molded using the same material as the blower duct 51A or may be formed using a material different from the blower duct 51A. The opening shape, the opening dimensions, the hole length, and the hole density of the air permeable sections (holes) 71 are selected and set in view of making the flow speed of air flowing out from the second bent path section 54C via the outlet 53 uniform as much as possible, and are also set in view of the dimensions (i.e., the capacity) of the blower duct 51A as well as the flow rate per unit time of air to be blown to the blower duct 51A or the charging device 4.

In the blower duct 51A according to the first exemplary embodiment, the inlet 52 has a rectangular opening shape that is slightly longer in the vertical direction, and the outlet 53 has a rectangular opening shape that is long in the horizontal direction. Thus, the inlet 52 and the outlet 53 have different opening shapes. Therefore, in the blower duct 51A, the path section 54 that connects the inlet 52 and the outlet 53 has a section where at least one of the cross-sectional shape (i.e., dimensions) of the path TS and the air flowing direction changes in mid-course. In this specification, even in a case where the inlet 52 and the outlet 53 have the same kind of shape (e.g., rectangular shapes), such a case is regarded that the inlet 52 and the outlet 53 have different opening shapes if the opening areas thereof are different from each other.

In a blower duct (51A) having such a mid-course changing section, turbulence, such as burbling or vortices, normally occurs in the section where the cross-sectional shape or the air flowing direction changes. Therefore, even if air with a uniform flow speed is taken in from the inlet 52, it is known that the flow speed of air exiting from the outlet 53 tends to become non-uniform especially in the longitudinal direction B of the outlet 53.

In order to prevent this, the present applicant has proposed, for example, a blower device equipped with a blower duct provided with multiple flow control members, as indicated in Japanese Unexamined Patent Application Publication No. 2013-88731. In the blower duct 51A according to the first exemplary embodiment, two flow control members 61A and 62 are provided so that non-uniformity of flow speed, in the longitudinal direction B, of air output from the outlet 53 may be reduced, as described above.

However, as a result of further research, it has been newly found that, when the amount of air to be blown to a target structure to which air is blown is relatively increased in the proposed blower device equipped with the blower duct described above, non-uniformity of flow speed, especially in the longitudinal direction B, of air output from the outlet 53 tends to increase. Moreover, in this case, it has been found that non-uniformity of flow speed also tends to start increasing in the lateral direction C (e.g., FIGS. 3 and 5) orthogonal to the longitudinal direction B of the outlet 53.

As shown in, for example, FIGS. 4 and 7, in the blower duct 51A according to the first exemplary embodiment, the path TS of the path section 54 has a downstream path TS2 located downstream, in the air flowing direction, of the first flow control member 61A. A portion of the downstream path TS2 is provided with an inclined inner wall surface 57A that is inclined from above so as to extend toward an upper portion 64*b* of a downstream opening end 64*a*, in the air flowing direction, of the gap 64 in the first flow control member 61A. Reference character TS1 in FIG. 4 and so on denotes an upstream path included in the path TS of the path section 54 and located upstream, in the air flowing direction, of the first flow control member 61A.

As shown in FIG. 7, the inclined inner wall surface 57A according to the first exemplary embodiment is an inclined flat surface having a lower end 57*a* located at a substantially mid-height position of a maximum height H of the downstream path TS2 and an upper end 57*b* located at the highest position of the downstream path TS2. The maximum height H is a dimension in the downstream path TS2 from the terminal end surface 54*g* in the path TS of the second bent path section 54C.

The entire inclined inner wall surface 57A is located within a region closer toward the upper portion 64*b* of the downstream opening end 64*a* of the gap 64 relative to a substantially mid-position of a maximum depth L of the downstream path TS2. The maximum depth L is a distance measured from the upper portion 64*b* of the downstream opening end 64*a* of the gap 64 to a point where an extension line of the bottom surface 54*e* constituting the path TS of the first bent path section 54B comes into contact with an inner wall surface in the downstream path TS2.

Furthermore, the inclined inner wall surface 57A intersects, at a predetermined angle $\alpha$1, with an imaginary orthogonal plane VL relative to the flat portion of the bottom surface 54*e* in the path TS of the first bent path section 54B. Although this inclination angle $\alpha$1 may at least be about 2° or larger, the inclination angle $\alpha$1 is set within a range between, for example, 5° and 25° in the first exemplary embodiment. If this inclination angle $\alpha$1 is smaller than 2°, it may possibly be difficult to control the traveling direction of circulating air (E2*c*), to be described later, occurring in the downstream path TS2 to a desired direction.

Figure 8:
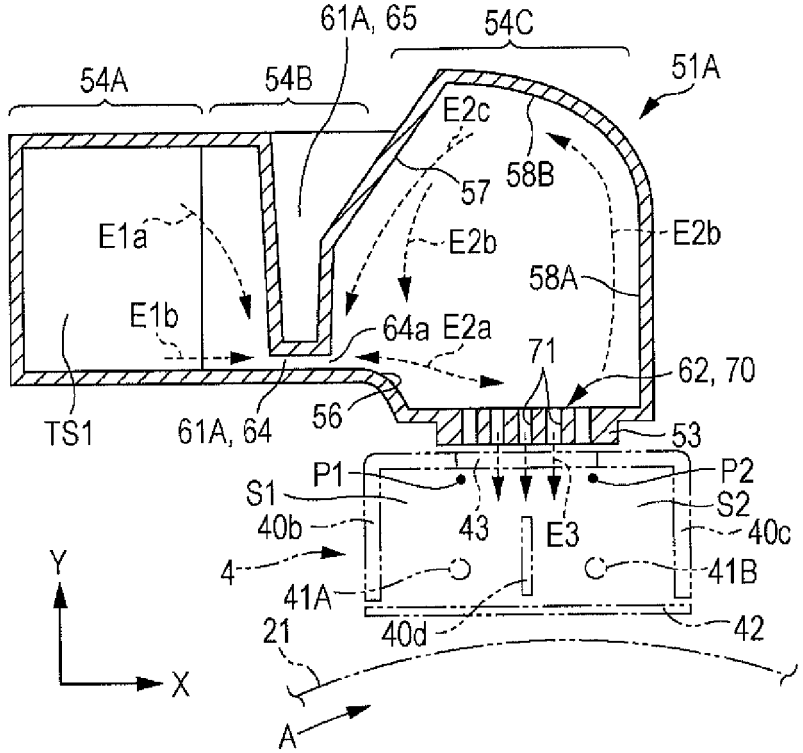
FIG. 8 illustrates the operational state of the blower device in FIG. 3.

As shown in, for example, FIGS. 7 and 8, with regard to the inclined inner wall surface 57A according to the first exemplary embodiment, the downstream inner wall surface section 65*c* of the blocking portion 65 is located between the lower end 57*a* and the upper portion 64*b* of the downstream opening end 64*a* of the gap 64.

The inclined inner wall surface 57A is desirably configured to have its lower end 57*a* located as close to the upper portion 64*b* of the downstream opening end 64*a* of the gap 64 as possible. For example, the lower end 57*a* may be configured to intersect (meet) with the upper portion 64*b* of the downstream opening end 64*a* of the gap 64.

With regard to the blocking portion 65 according to the first exemplary embodiment, if the blocking portion 65 is to be fabricated by, for example, a method that involves a die-cutting process, the upstream inner wall surface section 65*a* and the downstream inner wall surface section 65*c* of the blocking portion 65 are formed as inclined surfaces for die-cutting that are slightly inclined (e.g., at an angle of about 1°) so as to become gradually distant from the aforementioned imaginary orthogonal plane VL as they extend upward. Such inclined surfaces for die-cutting are not included in the aforementioned inclined inner wall surface 57A.

Furthermore, in the blower duct 51A according to the first exemplary embodiment, a rear inner wall surface section 58 located downstream of the upper end 57*b* of the inclined inner wall surface 57A is provided in the downstream path TS2. The rear inner wall surface section 58 is constituted of an orthogonal rear inner wall surface section 58A extending upright substantially orthogonally from the terminal end surface 54*g* in the path TS of the second bent path section 54C, and a curved rear inner wall surface section 58B extending in a curved manner from the upper end of the orthogonal rear inner wall surface section 58A to the upper end 57*b* of the inclined inner wall surface 57A. For example, the upper end of the orthogonal rear inner wall surface section 58A is set at a height position slightly above the substantially mid-height position of the maximum height H (FIG. 7) of the downstream path TS2 (or at a height position between the lower end 57*a* and the upper end 57*b* of the inclined inner wall surface 57A).

Furthermore, for providing the blower duct 51A according to the first exemplary embodiment with the inclined inner wall surface 57A, a portion located downstream of the first flow control member 61A of the first bent path section 54B and a portion of the second bent path section 54C are formed so as to be higher than the entrance path section 54A or the first bent path section 54B by a predetermined dimension h2, as shown in, for example, FIG. 7. This is not particularly related to increasing or decreasing the amount of air to be blown in the blower duct 51A, but is intended for a case where the external shape of the blower duct 51A has to be partially changed when, for example, there is a demand for maintaining and not changing the internal capacity of the downstream path TS2 in a case where there is no inclined inner wall surface 57A.

Operation of Blower Device

An operation of the blower device 5 (i.e., an operation arising from the blower duct 51A) will be described below.

In the blower device 5, when a drive setting timing is reached, such as at the time of an image forming operation, the blower 50 is first rotationally driven so as to deliver a predetermined amount of air. The air (E) delivered from the activated blower 50 is taken in through the inlet 52 of the blower duct 51A via the connection duct 55, and subsequently flows into the path TS of the entrance path section 54A (FIG. 5).

Subsequently, as shown in FIGS. 5 and 8, the air (E) taken into the blower duct 51A flows into the path TS of the first bent path section 54B via the path TS of the entrance path section 54A (see, for example, arrows E1*a* and E1*b* in FIG. 5). The paths TS up to this point constitute the upstream path TS1. The air (E1) delivered to the first bent path section 54B passes through the gap 64 of the first flow control member 61A, whereby the air travels in a state where the traveling direction (i.e., the air flowing direction) thereof has been changed to a substantially orthogonal direction.

In this case, the flow of air (E2) passing through the gap 64 of the first flow control member 61A is controlled (i.e., increased in pressure) by passing through the gap 64 of the first flow control member 61A whose cross-sectional area is relatively smaller than that of the path TS of the entrance path section 54A, so as to flow out uniformly from the gap 64. In addition, the direction of the air (E2) when flowing out from the gap 64 of the first flow control member 61A is aligned with the direction substantially orthogonal to the longitudinal direction B of the outlet 53.

Subsequently, with regard to the air (E2) passing through the gap 64 of the first flow control member 61A and flowing into the path TS of the second bent path section 54C, a large portion (E2*a*) of the air (E2) passes through the gap 64 of the first flow control member 61A so as to flow substantially straight through the path TS of the second bent path section 54C, as shown in FIG. 8. With regard to the air (E2*a*) flowing substantially straight, a portion thereof turns downward where the outlet 53 is located while traveling straight, whereas a large portion (E2*b*) thereof moves in a circulating manner within the downstream path TS2. In other words, the large portion (E2*b*) ascends along the orthogonal rear inner wall surface section 58A of the rear inner wall surface section 58 in the downstream path TS2 and turns along the curved rear inner wall surface section 58B. Subsequently, the large portion (E2*b*) moves toward the outlet 53 located below the downstream path TS2.

In this case, the air (E2) flowing into the path TS of the second bent path section 54C flows into the downstream path TS2 having a capacity larger than that of the gap 64 of the first flow control member 61A so as to travel in a spreading manner within the downstream path TS2, and also travels in a circulating manner within the downstream path TS2 (E2*b*), so that the entire air (E2) moves in a circulating manner within the downstream path TS2 and is thus temporarily retained therein, whereby non-uniformity of flow speed may be reduced.

Finally, as indicated by arrows E3 in FIG. 8, the air (E2) flowing through the downstream path TS2 in a circulating manner and temporarily retained therein passes through the multiple air permeable sections (holes) 71 in the air permeable member 70 of the second flow control member 62 provided at the outlet 53 serving as the terminal end of the second bent path section 54C, so that the air (E2) is blown out from the outlet 53 in a state where the traveling direction thereof has been changed.

In this case, the air (E3) blown out from the outlet 53 passes through the multiple air permeable sections 71 in a region 70*b* of the air permeable member 70 whose opening area is relatively smaller than those of the path TS of the second bent path section 54C and the outlet 53, so that the air (E3) is delivered in a state where the flow thereof is controlled (i.e., in a state where the pressure is increased).

Accordingly, the air (E3) output from the outlet 53 of the blower duct 51A is output in a state where the flow speed thereof is substantially uniform especially in the longitudinal direction B of the opening shape (i.e., narrow rectangular shape) of the outlet 53.

In the blower device 5, in addition to the flow of the air (E) described above, the air (E2) passing through the gap 64 of the first flow control member 61A in the blower duct 51A and flowing into the downstream path TS2 includes a portion (E2*c*) of the air (E2*b*) traveling in a circulating manner within the downstream path TS2. As shown in an enlarged view in, for example, FIG. 9, at least the portion (E2*c*) travels along the inclined inner wall surface 57A in the downstream path TS2. Thus, the circulating air (E2*c*) travels at an angle toward the downstream opening end 64*a* of the gap 64 of the first flow control member 61A and ultimately moves to impinge against the flow of the air (E2) flowing out from the downstream opening end 64*a* of the gap 64.

Figure 9:
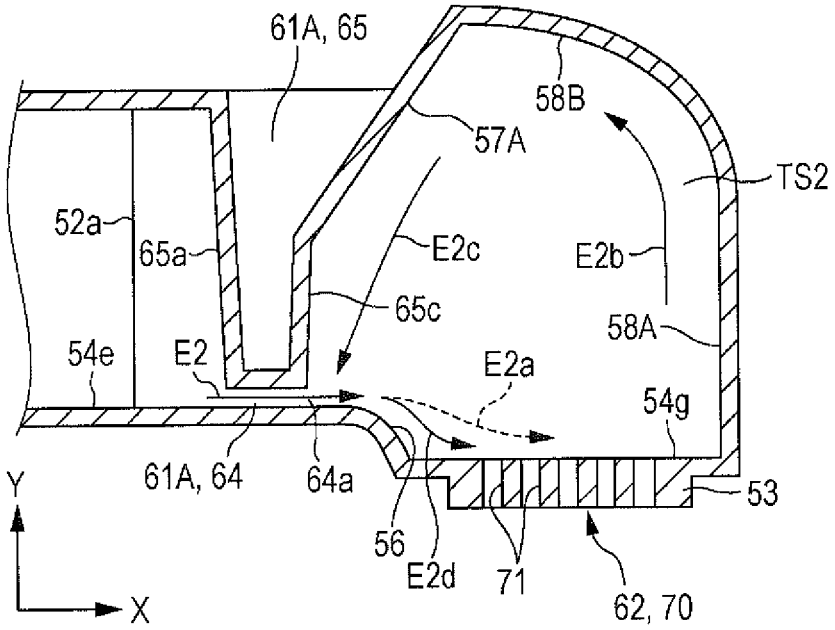
FIG. 9 is an enlarged view illustrating a relevant part (such as a downstream path and an inclined inner wall surface) of the operational state in FIG. 8.

Then, as shown in FIG. 9, the air (E2*c*) circulating along the inclined inner wall surface 57A flows reversely from above to impinge against the air (E2*a*) passing through the gap 64 of the first flow control member 61A and flowing substantially straight through the downstream path TS2. In other words, the flow of the circulating air (E2*c*) becomes a reverse impinging flow.

In this case, the air (E2*c*) acting as a reverse impinging flow impinges against the air (E2) flowing substantially straight into the downstream path TS2 so that the speed (flow speed) of the air (E2) passing through and ejected from the gap 64 of the first flow control member 61A is reduced. Accordingly, the air (E2) tends to be affected by the downward force applied from above by the circulating air (E2*b* and E2*c*) within the downstream path TS2, so as to become air (E2*d*) traveling toward the outlet 53 located below the downstream path TS2 in a state where the air (E2*d*) is bent more toward the lower side thereof.

This effect is effectively exhibited especially when a relatively large amount of air (E) (e.g., an average amount of 0.3 $m^3$/minute or larger) is taken in through the inlet 52. However, the effect is substantially similarly achieved even when a relatively small amount of air (E) (e.g., an average amount smaller than 0.3 $m^3$/minute) is taken in. Conceivably, this is because, for example, the speed (i.e., impinging speed) of the aforementioned impinging flow when impinging against the air (E2) is changed substantially in correspondence with the flow speed of the air (E2) passing through and ejected from the gap 64 of the first flow control member 61A, so that the aforementioned effect is strongly exhibited especially when the amount of air is relatively large, whereas the aforementioned effect relatively weakens and is appropriately exhibited when the amount of air is relatively small.

As a result, the air (E2) passing through the gap 64 of the first flow control member 61A and flowing into the downstream path TS2 is retained within the downstream path TS2 in a non-lopsided manner, so that the air (E2) flows substantially along the entire outlet 53 serving as the terminal end located below the downstream path TS2. Subsequently, when passing through the outlet 53 and output therefrom as air (E3), the air flows while receiving the reduction effect (i.e., pressure-increasing effect) again by the second flow control member 62. Therefore, with regard to the air (E3) output from the outlet 53, non-uniformity of flow speed may ultimately be reduced especially in the longitudinal direction B of the outlet 53.

Therefore, in the blower duct 51A, the air (i.e., E2*a* in particular) passing through the gap 64 of the first flow control member 61A and flowing into the downstream path TS2 receives, for example, a deceleration effect by the air (E2*c*) traveling along the inclined inner wall surface 57A in a circulating manner in the downstream path TS2 not only when a relatively small amount of air (E) is taken in through the inlet 52 but also when a relatively large amount of air (E) is taken in, so as to become air (E2*d*) traveling toward the outlet 53 located at the downwardly-bent terminal end in a state where the air (E2*d*) is bent more toward the lower side thereof. As a result, with regard to the air (E3) output from the outlet 53 in the blower duct 51A, non-uniformity of flow speed may be controlled especially in the longitudinal direction B of the outlet 53.

Furthermore, as shown in FIG. 8, the air (E3) output from the outlet 53 of the blower duct 51A in this blower device 5 is blown into the shield case 40 via the opening 43 in the top plate 40*a* of the shield case 40 of the charging device 4, and is subsequently blown onto the corona discharge wires 41A and 41B respectively disposed within the spaces (S1 and S2) divided by a partition wall 40*d* in an internal space S of the shield case 40 and onto the grid electrode 42 located at the lower opening of the shield case 40.

With regard to the air blown onto the corona discharge wires 41A and 41B and the grid electrode 42, since the air (E3) is output at a substantially uniform flow speed especially in the longitudinal direction B of the outlet 53 of the blower duct 51A, as described above, the air is also blown onto the corona discharge wires 41A and 41B and the grid electrode 42 in the substantially same state in the longitudinal direction B.

Accordingly, waste, such as paper particles, external additives in the toner, and discharge products, which may adhere to the two corona discharge wires 41A and 41B and the grid electrode 42 in the charging device 4, may be kept distant therefrom by blowing air uniformly thereto.

As a result, in the charging device 4, the occurrence of a degradation phenomenon, such as non-uniformity of discharge performance (electrostatic charging performance)

caused by sparse adhesion of waste onto the corona discharge wires 41A and 41B and the grid electrode 42 may be prevented, so that the peripheral surface of the photoconductor drum 21 may be electrostatically charged more evenly (along the rotation axis thereof).

Furthermore, with regard to a toner image to be formed at the image forming unit 20 equipped with this charging device 4, and by extension an image to be ultimately formed on the recording paper 9, a satisfactory image quality may be obtained in which the occurrence of image quality defects (such as uneven density) caused by charge defects, such as uneven charge, is reduced.

First Test

Figure 10:
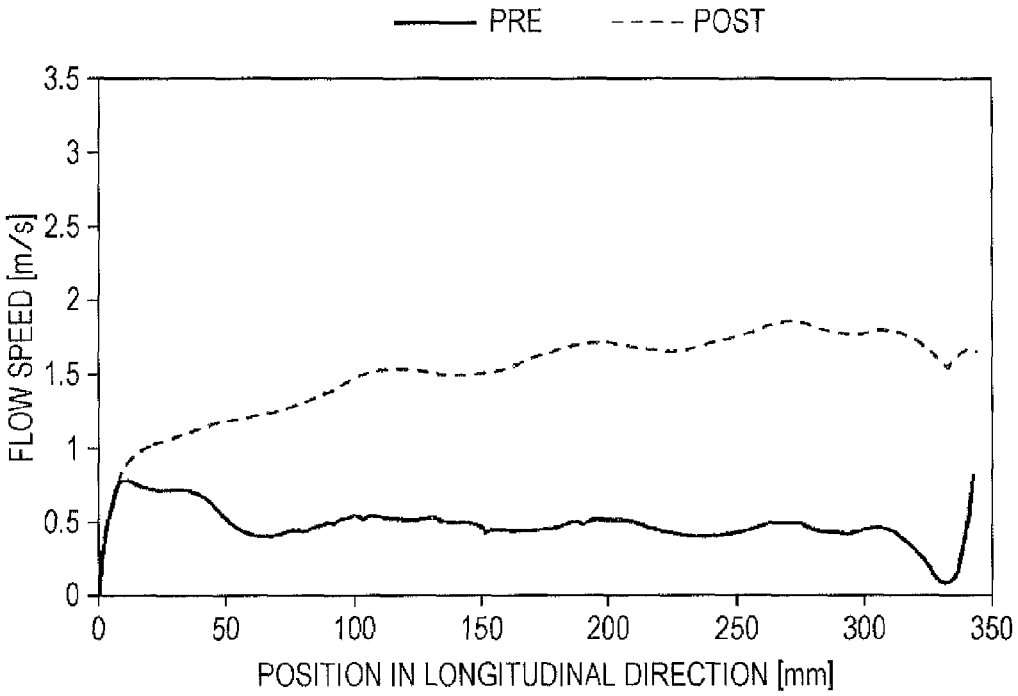
FIG. 10 is a graph illustrating a result of a first test related to a first example.

FIG. 10 illustrates a result of a first test performed for studying the performance characteristics of the blower device 5 (i.e., flow speed distribution in the outlet 53 of the blower duct 51A).

In the first test, the blower duct 51A used has the following conditions (first example), and the flow speed in the longitudinal direction B of the outlet 53 of the blower duct 51A is measured when a relative large average amount of air, namely, about 0.33 $m^3$/minute, from the blower 50 is introduced through the inlet 52 of the blower duct 51A.

The flow speed is measured by using an air speed meter (F900 manufactured by Cambridge AccuSense Inc.). Moreover, as shown in FIG. 8, the flow speed is measured at two positions, namely, an upstream position (pre-position) P1 located at the upstream side of the outlet 53 in a rotational direction A of the photoconductor drum 21 and a downstream position (post-position) P2 located at the downstream side of the outlet 53 in the rotational direction A, by moving the air speed meter across the entire region in the longitudinal direction B.

The result of the first test is shown in FIG. 10. In the abscissa in the graph shown in FIG. 10, the 0-mm side (left end) corresponds to an end 53*b* (FIG. 5), in the longitudinal direction B, of the outlet 53 located closer toward the inlet 52.

The overall shape of the blower duct 51A used in the first example is as shown in FIGS. 3 to 7. The inlet 52 has a substantially square opening shape of 22 mm×23 mm (i.e., a rectangular shape that is slightly longer in the vertical direction). The outlet 53 has a narrow rectangular opening shape of 17.5 mm×350 mm. The total capacity of the entire path TS of the blower duct 51A is about 600 $cm^3$.

With regard to the first flow control member 61A in the blower duct 51A, the gap 64 with a spacing distance d1 of 1.5 mm, a path length M1 of 8 mm, and a width W of 345 mm is disposed in contact with the bottom surface 54*e* of the first bent path section 54B in an area where a displacement amount N1 from the end 52*a* of the inlet 52 in the path TS of the entrance path section 54A is 6 mm and a displacement amount J from the terminal end 54*m* of the flat portion of the bottom surface 54*e* in the upstream path TS1 is about 1 mm. The upstream inner wall surface section 65*a* and the downstream inner wall surface section 65*c* of the blocking portion 65 in the first flow control member 61A are slightly inclined at about 1° as a die-cutting angle.

Furthermore, with regard to the second flow control member 62 in the blower duct 51A, the air permeable member 70 provided with the air permeable sections (holes) 71 with a hole diameter of 1 mm and a length of 3 mm and at a density of 0.42 holes/$mm^2$ (≈42 holes/$cm^2$) is used.

The inclined inner wall surface 57A is shaped and located as shown in, for example, FIG. 7. Specifically, the inclined inner wall surface 57A is a flat inclined surface in which the distance between the lower end 57*a* and the upper end 57*b* is 15 mm and an angle α1 forming the aforementioned imaginary orthogonal plane VL is 25°. The lower end 57*a* of the inclined inner wall surface 57A is disposed so as to be located at a substantially mid-height position of the maximum height H (about 25 mm) of the downstream path TS2. The capacity of the downstream path TS2 is 2850 $cm^3$. The downstream inner wall surface section 65*c* of the blocking portion 65 located below the lower end 57*a* of the inclined inner wall surface 57A is a surface in which the distance between the lower end and the upper end thereof is 10 mm.

Figure 17:
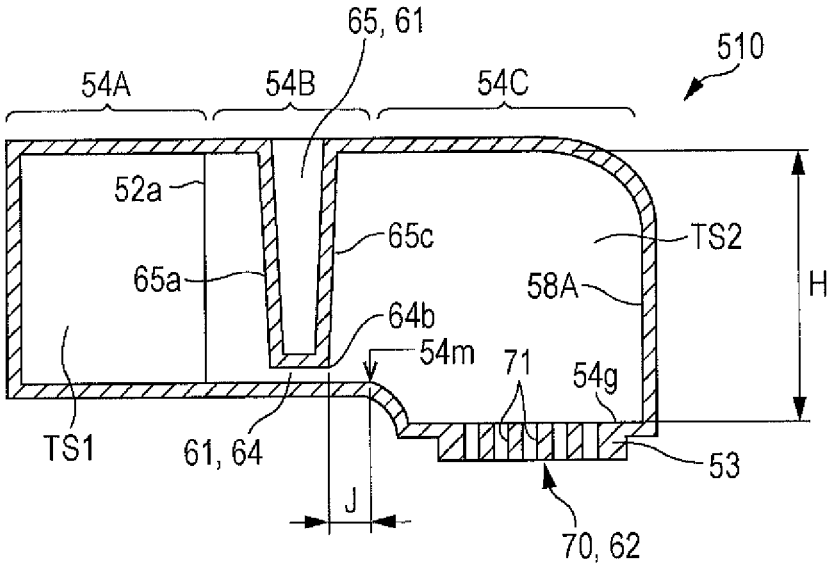
FIG. 17 is a cross-sectional view schematically illustrating a blower device (blower duct) according to a comparative example.

For comparison, the first test is performed in a manner similar to the first example by using an example of a blower duct (i.e., a blower duct 510 shown in FIG. 17) proposed in Japanese Unexamined Patent Application Publication No. 2013-88731. The result obtained is shown in FIG. 18.

The blower duct 510 according to the comparative example is modified by simply not providing the downstream path TS2 in the blower duct 51A according to the first example with the inclined inner wall surface 57A and also by changing the following conditions. Other features are similar to those in the blower duct 51A according to the first example.

Specifically, with regard to the downstream path TS2 in the blower duct 510, the capacity thereof is set to the same value as in the first example. Therefore, due to not being provided with the inclined inner wall surface 57A, the maximum height H of the downstream path TS2 is changed to 23 mm. Moreover, with regard to the first flow control member 61 in the blower duct 510, the lower end at the downstream side of the blocking portion 65 is positionally set such that the displacement amount J from the terminal end 54*m* of the flat portion of the bottom surface 54*e* in the upstream path TS1 is about 2 mm.

Figure 18:
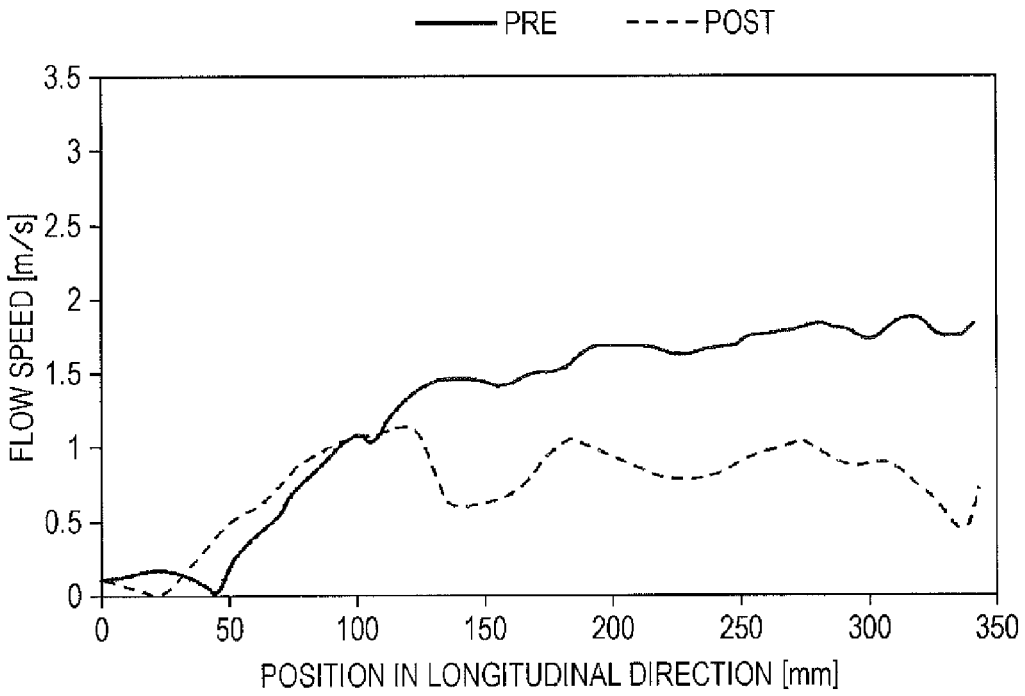
FIG. 18 is a graph illustrating a result of a first test related to the comparative example.

It is clear from the result shown in FIG. 10 that, in the first example that uses the blower duct 51A, non-uniformity of flow speed in the longitudinal direction B of the outlet 53 may be reduced substantially in the entire region in the longitudinal direction B, as compared with the comparative example that uses the blower duct 510 (FIG. 18).

Figure 19:
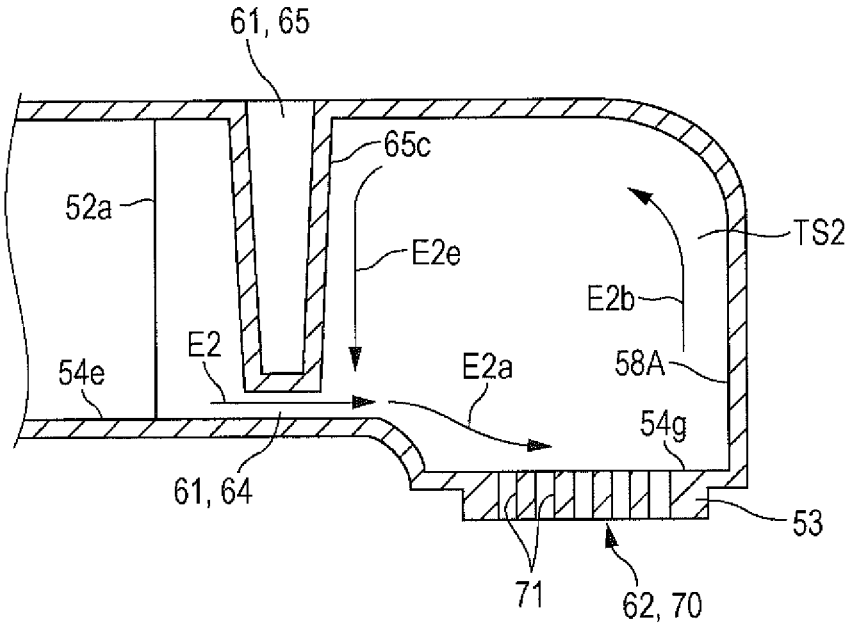
FIG. 19 is an enlarged view illustrating the operational state in a relevant part of the blower duct in FIG. 17.

In the case where the blower duct 510 according to the comparative example is used, the air (E2*b*) passing through the gap 64 of the first flow control member 61 and circulating in the downstream path TS2 moves along the downstream inner wall surface section 65*c* of the blocking portion 65, as shown in an enlarged view in FIG. 19. Thus, the ultimately circulating air (E2*e*) flows to impinge, from above at a substantially orthogonal angle, against the air (E2*a*) passing through the gap 64 of the first flow control member 61A and traveling substantially straight. As a result, the ultimately circulating air (E2*e*) does not cause the flow speed of the air (E2*a*) traveling substantially straight to decrease, so that the air (E2*a*) is less likely to be affected by the downward force of the circulating air (E2*b* and E2*e*). Therefore, in the case where the blower duct 510 according to the comparative example is used, it is assumed that non-uniformity of flow speed in the longitudinal direction B of the outlet 53 of the blower duct 510 is less likely to be reduced when a relatively large amount of air is taken in.

Second Test

In a second test, the flow speed in the lateral direction C of the outlet 53 of the blower duct 51A according to the first example used in the first test is similarly measured at multiple positions in the longitudinal direction B of the outlet 53. The multiple positions are distant by 50 mm downward from the lower end of the outlet 53 and are included in the entire region (the length of the entire region in the lateral direction C is 70 mm) located between an upstream position and a downstream position, which are distant by 35 mm from the center point of the outlet 53 in the lateral direction C to the upstream side and the downstream side, respectively, in the rotational direction A of the photoconductor drum 21. The result of the second test is shown in FIG. 11.

The second test is similarly performed by using the blower duct 510 according to the comparative example in the first test described above.

Figure 11:
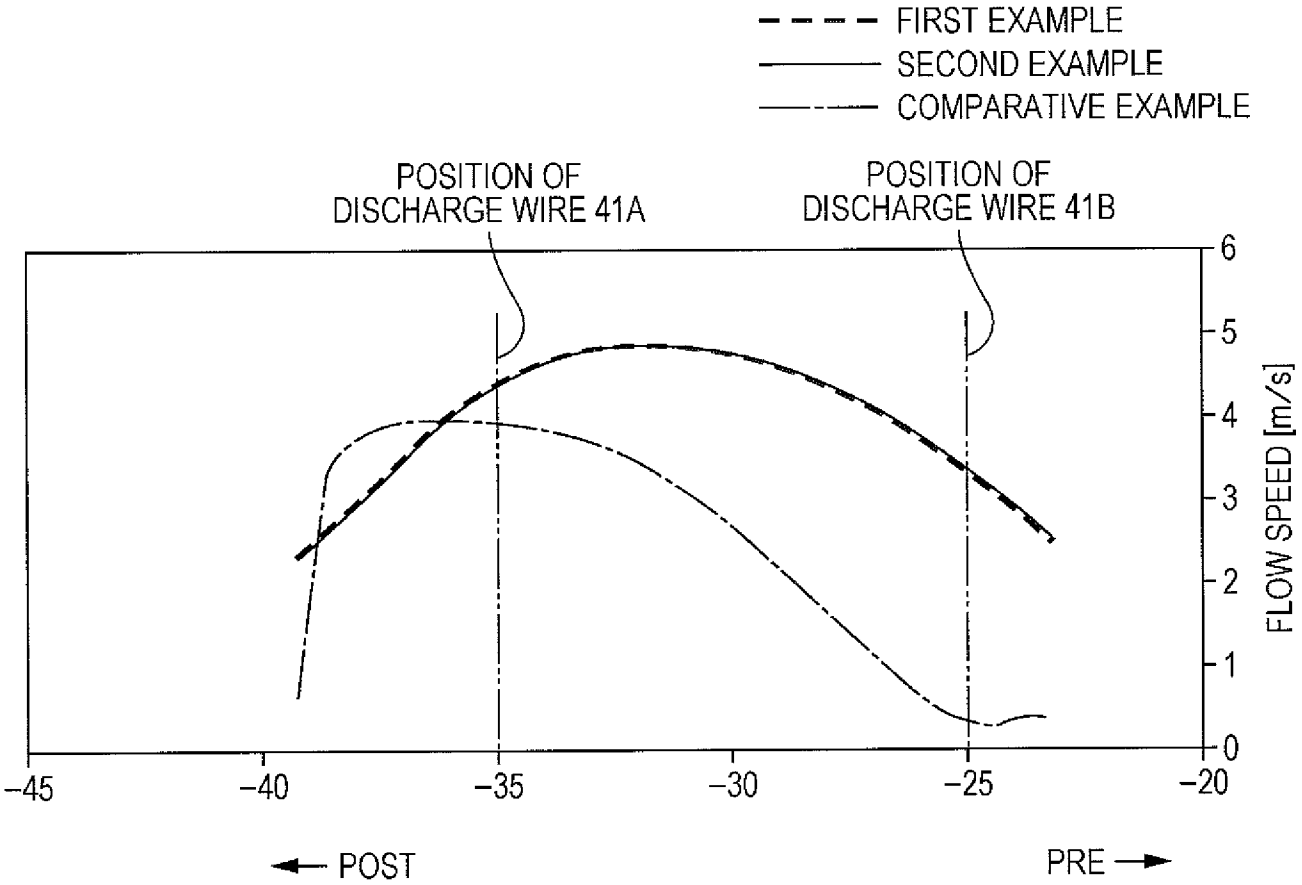
FIG. 11 is a graph illustrating a result of a second test.

It is clear from the result shown in FIG. 11 that, in the first example that uses the blower duct 51A, non-uniformity of flow speed in the lateral direction C of the outlet 53 may also be reduced, as compared with the comparative example that uses the blower duct 510.

Second Exemplary Embodiment

Figure 12:
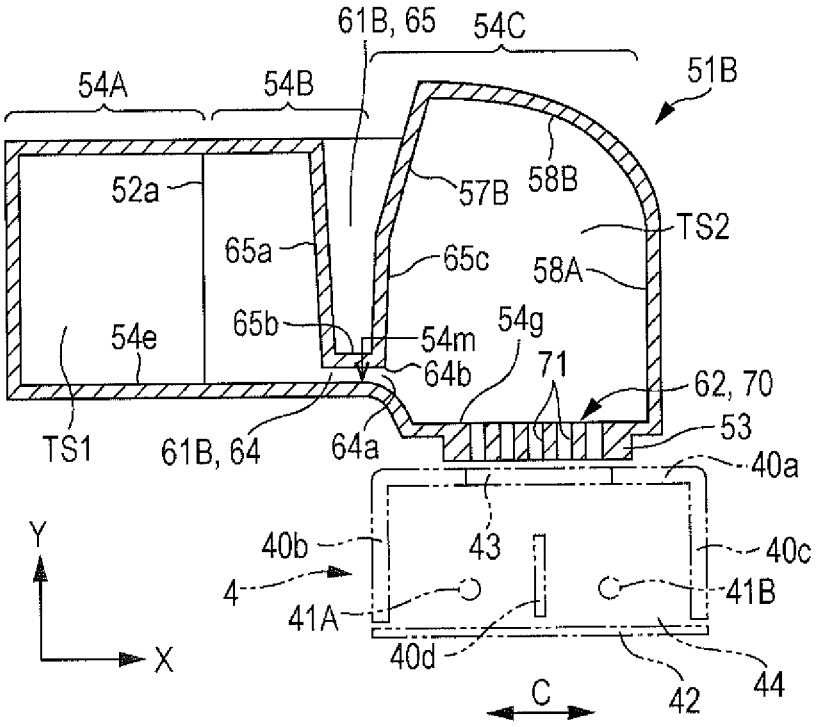
FIG. 12 is a cross-sectional view schematically illustrating a blower device (blower duct) according to a second exemplary embodiment.

FIG. 12 schematically illustrates a relevant part (including a blower duct 51B) of a blower device 5 according to a second exemplary embodiment.

In place of the first flow control member 61A according to the first exemplary embodiment, the blower duct 51B in the blower device 5 according to the second exemplary embodiment uses a first flow control member 61B whose position is slightly displaced. Thus, an inclined inner wall surface 57B with slightly different conditions is provided in place of the inclined inner wall surface 57A in the first exemplary embodiment. Other features are similar to those in the blower duct 51A according to the first exemplary embodiment.

Figure 13:
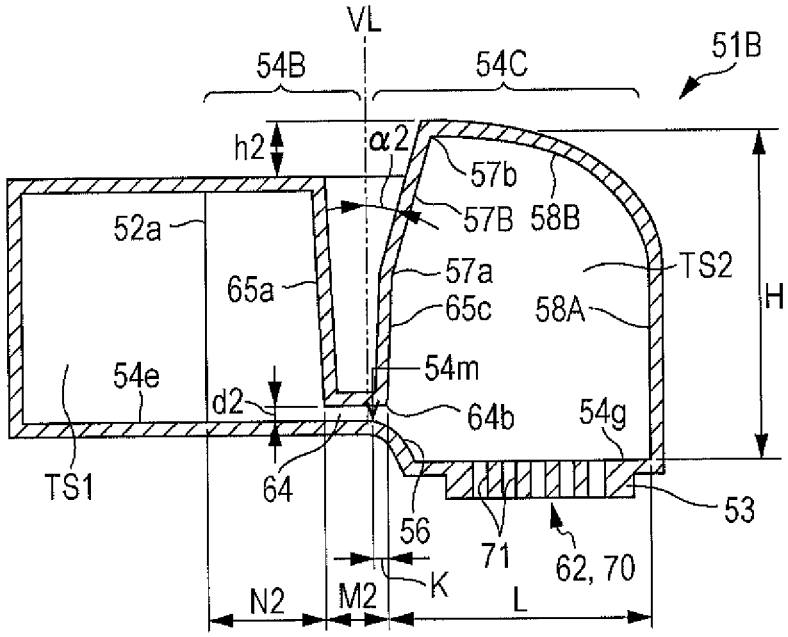
FIG. 13 illustrates the configuration of the blower device in FIG. 12 in detail.

As shown in, for example, FIGS. 12 and 13, in the first flow control member 61B in the blower duct 51B, the upper portion 64*b* of the downstream opening end 64*a* of the gap 64 is disposed facing the inner wall surface section 56 constituting the path TS of the second bent path section 54C, which connects with the terminal end 54*m* of the flat portion of the bottom surface 54*e* in the path TS of the first bent path section 54B. The inner wall surface section 56 serves as the inner wall surface section 56 (FIG. 7) described in the first exemplary embodiment. Specifically, the inner wall surface section 56 is an inner wall surface that is curved between the terminal end 54*m* of the bottom surface 54*e* of the first bent path section 54B and the terminal end surface 54*g* of the second bent path section 54C.

The upper portion 64*b* of the downstream opening end 64*a* of the gap 64 is disposed facing an intermediate position of the curved surface of the inner wall surface section 56. A displacement amount K by which the upper portion 64*b* of the downstream opening end 64*a* of the gap 64 is displaced by protruding downstream in the air flowing direction from the terminal end 54*m* of the bottom surface 54*e* of the first bent path section 543 is set to a desired dimensional value.

As shown in FIG. 13, with regard to the first flow control member 61B, a spacing distance d2 and a path length M2 of the gap 64 and a displacement amount N2 of the blocking portion 65 from the inner end 52*a* of the inlet 52 are set to desired dimensional values. In the second exemplary embodiment, the spacing distance d2 and the path length M2 of the gap 64 of the first flow control member 61B are respectively set equal to the spacing distance d1 and the path length M1 of the gap 64 of the first flow control member 61A according to the first exemplary embodiment. Furthermore, the displacement amount N2 of the blocking portion 65 of the first flow control member 61B is set to be larger than the displacement amount N1 of the blocking portion 65 of the first flow control member 61A according to the first exemplary embodiment in correspondence with the change in position of the upper portion 64*b* of the downstream opening end 64*a* of the gap 64, as described above.

As shown in FIG. 13, with regard to the inclined inner wall surface 57B in the blower duct 51B, an angle $\alpha 2$ relative to the imaginary orthogonal plane VL is set to be smaller than the angle $\alpha 1$ of the inclined inner wall surface 57A according to the first exemplary embodiment. Moreover, the upper end 57*b* of the inclined inner wall surface 57B is changed in position closer toward the entrance path section 54A, as compared with the upper end 57*b* of the inclined inner wall surface 57A according to the first exemplary embodiment, due to the setting of the angle $\alpha 2$ and the restriction of maintaining the capacity of the downstream path TS2 constant. Other conditions for the inclined inner wall surface 57B are substantially the same as the conditions for the inclined inner wall surface 57A according to the first exemplary embodiment.

The rear inner wall surface section 58 in the blower duct 51B has a substantially similar configuration except that the upper end of the curved rear inner wall surface section 58B is displaced toward the entrance path section 54A, as compared with the curved rear inner wall surface section 58B according to the first exemplary embodiment. Furthermore, as shown in FIG. 13, although the second bent path section 54C having the downstream path TS2 is positionally set higher than the entrance path section 54A by a dimension h2, this height difference is substantially equal to the difference (h1) in the case of the blower duct 51A according to the first exemplary embodiment (FIG. 7).

The blower device 5 equipped with the blower duct 51B operates in a manner substantially similar to the blower device 5 according to the first exemplary embodiment.

Figure 14:
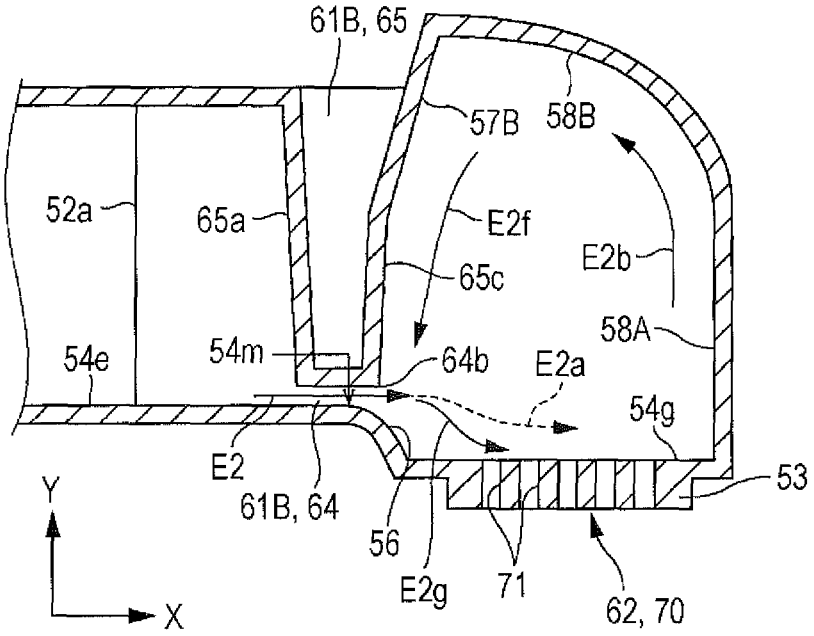
FIG. 14 is an enlarged view illustrating the operational state in a relevant part of the blower device in FIG. 12.

As shown in, for example, FIG. 14, in the blower duct 51B, the air (E2) passing through the gap 64 of the first flow control member 61B and flowing into the downstream path TS2 includes a portion (E2*f*) of the air (E2*b*) traveling in a circulating manner within the downstream path TS2. At least the portion (E2*f*) passes through the inclined inner wall surface 57B located in the downstream path TS2. Thus, the circulating air (E2*f*) travels at an angle toward the downstream opening end 64*a* of the gap 64 of the first flow control member 61B and ultimately moves to impinge against the flow of the air (E2) flowing out from the downstream opening end 64*a* of the gap 64.

Specifically, the air (E2*f*) circulating along the inclined inner wall surface 57B flows reversely from above to impinge against the air (E2*a*) passing through the gap 64 of the first flow control member 61B and flowing substantially straight through the downstream path TS2. In other words, the flow of the circulating air (E2*f*) becomes a reverse impinging flow.

As a result, the air (E2*f*) acting as a reverse impinging flow impinges against the air (E2) flowing substantially straight through the downstream path TS2 so that the speed (flow speed) of the air (E2) passing through and ejected from the gap 64 of the first flow control member 61B is reduced. Accordingly, the air (E2) tends to be affected by the downward force applied from above by the circulating air (E2*b* and E2*f*) within the downstream path TS2, so as to become air (E2*g*) traveling toward the outlet 53 located below the downstream path TS2 in a state where the air (82*g*) is bent more toward the lower side thereof.

Therefore, in the blower duct 51B, the air (i.e., E2*a* in particular) passing through the gap 64 of the first flow control member 61B and flowing into the downstream path TS2 receives, for example, a deceleration effect by the air (E2*f*) traveling along the inclined inner wall surface 57B in a circulating manner in the downstream path TS2 not only when a relatively small amount of air (E) is taken in through the inlet 52 but also when a relatively large amount of air (E) is taken in, so as to become air (E2*g*) traveling toward the outlet 53 located at the downwardly-bent terminal end in a state where the air (E2*g*) is bent more toward the lower side thereof. As a result, with regard to the air (E3) output from the outlet 53 in the blower duct 51B, non-uniformity of flow speed may be controlled especially in the longitudinal direction B of the outlet 53.

First Test

The first test performed in the first exemplary embodiment is similarly performed on the blower device 5 equipped with the blower duct 51B. The result obtained is shown in FIG. 15.

The blower duct 51B (second example) used in the first test has a configuration similar to that of the blower duct 51A used in the first test in the first exemplary embodiment except that the displacement amount N2 of the blocking portion 65 in the first flow control member 61B is 5 mm and the displacement amount K of the gap 64 is 1 mm.

Figure 15:
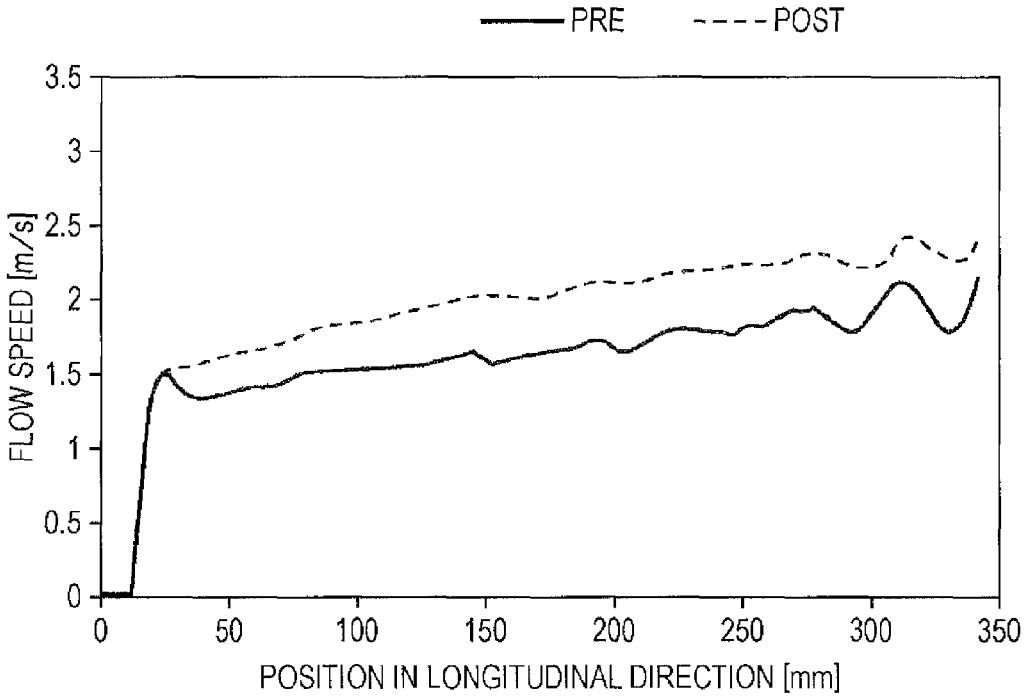
FIG. 15 is a graph illustrating a result of a first test related to a second example.

It is clear from the result shown in FIG. 15 that, in the second example that uses the blower duct 51B, non-uniformity of flow speed in the longitudinal direction B of the outlet 53 may be reduced substantially in the entire region in the longitudinal direction B, as compared with not only the comparative example (FIG. 18) that uses the blower duct 510 but also the first example (FIG. 10) that uses the blower duct 51A according to the first exemplary embodiment. Furthermore, in the second example, it is clear that non-uniformity of flow speed in the longitudinal direction B of the outlet 53 may be reduced substantially in the entire region in the longitudinal direction B, as compared with the first example (FIG. 10).

Second Test

The second test in the first exemplary embodiment is similarly performed on the blower device 5 equipped with the blower duct 51B. The result obtained is shown in FIG. 11.

It is clear from the result shown in FIG. 11 that the second example that uses the blower duct 51B is similar to the case of the first example in that non-uniformity of flow speed in the lateral direction C of the outlet 53 may be reduced, as compared with the comparative example that uses the blower duct 510.

Other Exemplary Embodiments

The blower duct 51 used in the blower device 5 is not limited to the blower ducts 51A and 51B described in the first and second exemplary embodiments and may alternatively be a partially-modified blower duct 51.

Figure 16:
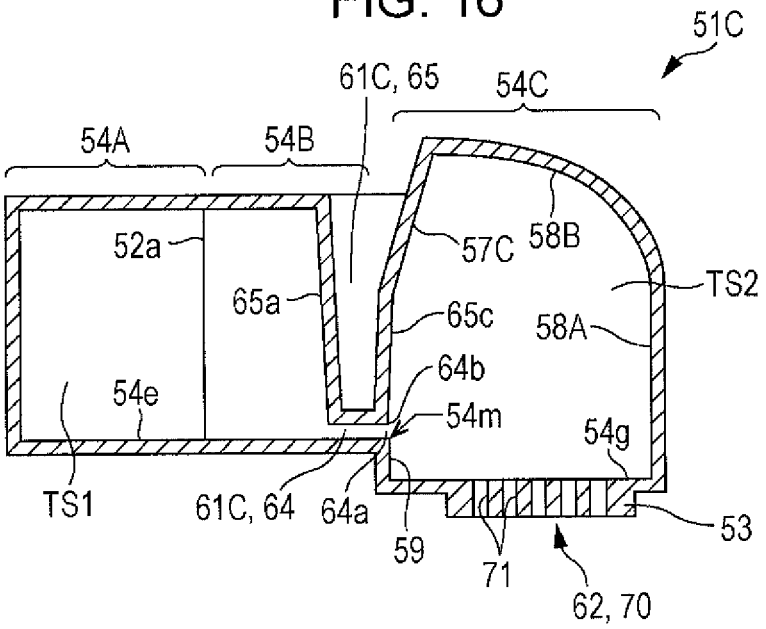
FIG. 16 is a cross-sectional view illustrating another configuration example of the blower tube.

For example, as shown in FIG. 16, a blower duct 51C having a vertical inner wall surface 59 in place of the inner wall surface section 56 constituting the downstream path TS2 may be used. Specifically, the vertical inner wall surface 59 is located between the terminal end 54*m* of the flat portion of the bottom surface 54*e* in the path TS of the first bent path section 54B and the terminal end surface 54*g* of the second bent path section 54C and extends upright substantially vertically relative to the terminal end surface 54*g*. In this blower duct 51C, the upper portion 64*b* of the downstream opening end 64*a* of the gap 64 in a first flow control member 61C is disposed facing the terminal end 54*m* of the flat portion of the bottom surface 54*e* (in this case, the aforementioned displacement amount K of the gap 64 is substantially zero). Furthermore, in the blower duct 51C, an inclined inner wall surface 57C has a configuration substantially similar to that of the inclined inner wall surface 57B according to the second exemplary embodiment.

When air is blown into this blower duct 51C, the air circulating along the inclined inner wall surface 57C is produced as a reverse impinging flow, so that non-uniformity of flow speed may be controlled at least in the longitudinal direction B of the outlet 53.

Furthermore, in the blower duct 51B according to the second exemplary embodiment, the upper portion 64*b* of the downstream opening end 64*a* of the gap 64 in the first flow control member 61B may be modified so as to be disposed facing the terminal end 54*m* of the flat portion of the bottom surface 54*e*.

With regard to the blower duct 51 used in the blower device 5, the configuration of the rear inner wall surface section 58 located rearward of the inclined inner wall surface 57 and included in the inner wall surface constituting the downstream path TS2 may be modified in various manners so long as a reverse impinging flow is producible from the air traveling along the inclined inner wall surface 57. As another example, the rear inner wall surface section 58 may be constituted of the rear inner wall surface section 58A alone that extends upright vertically from the terminal end surface 54*g* to the upper end 57*b* of the inclined inner wall surface 57.

In the blower duct 51 used in the blower device 5, each of the inclined inner wall surfaces 57A to 57C in the first flow control member 61 may alternatively be constituted of a component different from the blocking portion 65 instead of being constituted of a portion of the downstream surface section 65*b* of the blocking portion 65, as described in the first and second exemplary embodiments.

Furthermore, in the blower duct 51 used in the blower device 5, the second flow control member 62 provided at the outlet 53 is not limited to the air permeable member 70 described in the first and second exemplary embodiments. For example, the air permeable member 70 used may be a porous member (having multiple air permeable sections 71 with irregular shapes extending therethrough), such as a nonwoven fabric used as, for example, a filter.

Furthermore, the charging device 4 to which the blower device 5 is applied may be a charging device of a type that does not have the grid electrode 42 installed therein, namely, a so-called corotron-type charging device. Moreover, the charging device 4 may be of a type that uses a single corona discharge wire 41 or three or more corona discharge wires 41. Furthermore, the target structure to which the blower device 5 is applied may be a corona discharger that removes electricity from, for example, the photoconductor drum 21 or a corona discharger that electrostatically charges or removes electricity from a charge body other than the photoconductor drum 21. The target structure may alternatively be, for example, a long structure, other than a corona discharger, to which air is to be blown.

With regard to the image forming apparatus 1, the configuration thereof for, for example, image formation is not particularly limited so long as it is equipped with a long target structure to which the blower device 5 is applied. For example, although the image forming apparatus 1 uses a single image forming unit 20 to form a monochromatic image in the first exemplary embodiment, the image forming apparatus 1 may alternatively be of a type that forms a multicolor image by using multiple image forming units 20 that form images of different colors. Where appropriate, the image forming apparatus 1 may employ a different image forming method for forming an image formed of a material other than a developer.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A blower duct comprising:

a path section including an entrance path section having a path whose one end is provided with an inlet through which air is taken in, a first bent path section having a path that bends in a horizontal direction from an intermediate point of the entrance path section, and a second bent path section having a path that bends downward from a terminal end of the first bent path section and that is provided with an outlet at a downwardly-bent terminal end, the outlet having an opening shape extending so as to face a longitudinal-direction portion that is long in one direction of a target structure to which the air taken in through the inlet is blown;

a first flow control member that makes a portion of the path of the first bent path section narrower than other portion of the path and causes an elongated gap extending in the longitudinal direction to pass the air; and a second flow control member constituted of an air permeable member having a plurality of air permeable sections provided at the outlet, wherein, of the paths of the path section, a path located downstream of the first flow control member in an air flowing direction is partially provided with an inclined inner wall surface that is inclined from above so as to extend toward an upper portion of a downstream opening end, in the air flowing direction, of the narrowed path in the first flow control member.

2. The blower duct according to claim 1, wherein the upper portion of the downstream opening end, in the air flowing direction, of the narrowed path in the first flow control member is disposed facing a terminal end of a flat portion of a bottom surface constituting the path of the first bent path section.

3. The blower duct according to claim 1, wherein the upper portion of the downstream opening end, in the air flowing direction, of the narrowed path in the first flow control member is disposed facing a portion of a bottom surface constituting the path of the second bent path section, which connects with a terminal end of a flat portion of a bottom surface constituting the path of the first bent path section.

4. The blower duct according to claim 1, wherein the inclined inner wall surface intersects at an angle of about 2° or larger with an imaginary orthogonal plane relative to a flat portion of a bottom surface constituting the path of the first bent path section.

5. An image forming apparatus comprising:

a target structure having a longitudinal-direction portion that is long in one direction; and the blower device according to claim 4 that blows air to the longitudinal-direction portion of the target structure.

6. A blower device comprising:

a blower that blows air; and the blower duct according to claim 1 that takes in the air blown from the blower.

* * * * *